US006381978B1

(12) United States Patent
Moretti et al.

(10) Patent No.: US 6,381,978 B1
(45) Date of Patent: May 7, 2002

(54) BASE PAN ASSEMBLY FOR AIR CONDITIONER

(75) Inventors: Stephen L. Moretti, Auburn; Kenneth J. Meyer, Oswego, both of NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/859,574

(22) Filed: May 16, 2001

(51) Int. Cl.[7] ..... F25B 29/00
(52) U.S. Cl. ..... 62/262; 62/285
(58) Field of Search ..... 62/262, 285, 288, 62/297, 411, 427; 165/59

(56) References Cited

U.S. PATENT DOCUMENTS 5,085,057 A * 2/1992 Thompson et al. ..... 62/262
5,372,189 A * 12/1994 Tsunekawa et al. ..... 165/59
5,697,227 A * 12/1997 Bruce et al. ..... 62/285
5,732,565 A * 3/1998 Ramakrishnan et al. ..... 62/298
6,085,539 A 7/2000 Meyer ..... 62/285
6,168,248 B1 * 1/2001 Timmons et al. ..... 312/264
6,182,460 B1 * 2/2001 Hernandez et al. ..... 62/262

* cited by examiner

*Primary Examiner*—William Doerrler
*Assistant Examiner*—Melvin Jones
(74) *Attorney, Agent, or Firm*—Wall, Marjama & Bilinski, LLP

(57) ABSTRACT

Apparatus for supporting the components of an air conditioner unit having an indoor section and an outdoor section, each of which contain a heat exchanger and a fan. A base pan is provided to support the components of the unit and an auxiliary pan is mounted inside the base pan beneath the indoor fan and the indoor heat exchanger. A shroud surrounds the indoor fan that contains a scroll for directing conditioned air into a horizontally disposed passage that distributes the air uniformly across the unit. The auxiliary pan contains a trough that forms part of the scroll. Both the shroud and the auxiliary pan are cast from light-weight styrene.

8 Claims, 5 Drawing Sheets

BASE PAN ASSEMBLY FOR AIR CONDITIONER

BACKGROUND OF THE INVENTION

This invention relates to a base pan for an air conditioning unit and, in particular, to a base pan for a packaged terminal air conditioner (PTAC).

The present invention involves a base pan that is ideally suited for use in association with a packaged terminal air conditioner of the type generally used in hotels and motels or similar places of lodging where the air conditioning unit services a specific indoor comfort area such as a room to provide both heating and cooling. The PTAC unit is generally contained within a rectangular shaped sleeve that is mounted within an outside wall of the building in which the comfort area being serviced is housed. The unit typically includes an outdoor section and an indoor section that are separated by a dividing wall. Each section includes a heat exchanger and a fan for moving air over the heat exchanger surfaces.

It is common within the industry to utilize condensate produced by an indoor heat exchanger to cool the outdoor heat exchanger when the unit is operated in the cooling mode. This concept is more fully described in U.S. Pat. No. 6,067,812 that issued in the name of Bushnell et al. As described in the noted patent, the condensate from the indoor heat exchanger which is functioning as an evaporator in the cooling mode is collected in the base pan and is fed via gravity to an area beneath the outdoor fan which is now functioning as a condenser. The outdoor fan is equipped with a slinger ring that is arranged to pass through the condensate and distribute it over the outdoor heat exchanger to cool the heat exchanger surfaces thereby increasing the efficiency of the unit. This method of increasing the efficiency of a unit works well in practice, however, it takes a good deal of time after start up to provide sufficient condensate to the outdoor fan to begin the cooling process.

In U.S. Pat. No. 6,085,539 there is described a base pan for use in a PTAC unit that is designed to route condensate from the indoor heat exchanger to the outdoor fan. A condenser pan is removably mounted inside the base pan beneath the indoor heat exchanger. The base pan and the condenser pan have a number of tiers that allow the condensate from the indoor heat exchanger to cascade downwardly into a low collection region in the base pan beneath the outdoor heat exchanger. The collection region is thus relatively large and accordingly, a good deal of condensate must be collected before the outdoor fan can effectively distribute the condensate over the surfaces of the outdoor heat exchanger. The floor contours of the two metal pans are also relatively complex and thus relatively difficult to form as well as adding additional weight to the system.

SUMMARY OF THE INVENTION

It is therefore an object of the present invention to improve air conditioning systems and, in particular, packaged terminal air conditioning systems.

It is a further object of the present invention to provide a condensate control system for delivering condensate to the outdoor section of a PTAC unit shortly after the unit is placed in a cooling mode.

A still further object of the present invention is to provide a two piece base pan for an air conditioner that is relatively light weight and more easily formed when compared to similar base pans known in the prior art.

Another object of the present invention is to provide a light-weight auxiliary pan that is insertable into the base pan of an air conditioner unit that plays a part in the efficient distribution of comfort air as it is being discharged from the unit.

These and other objects of the current invention are attained in an air conditioning unit that contains an indoor section and an outdoor section that are separated by a dividing wall. Each section includes a heat exchanger and a fan for moving air over the surfaces of the heat exchanger. The unit further includes a base pan that has a floor and four raised side walls integral with the floor that encircle the unit. The floor of the base pan slants inwardly toward a reservoir area immediately adjacent to the indoor fan so that condensate collected in the reservoir is immediately available for use in cooling the outdoor heat exchanger. An auxiliary pan molded of light weight styrene is mounted inside the base pan beneath the indoor heat exchanger. The auxiliary pan contains a trough having an inside surface contour that forms a section of a shroud that surrounds the indoor fan.

BRIEF DESCRIPTION OF THE DRAWINGS

For a better understanding of these and other objects of the invention, reference will be made to the following detailed description of the invention which is to be read in association with the accompanying drawing, wherein.

DETAILED DESCRIPTION OF THE INVENTION

Figure 1:
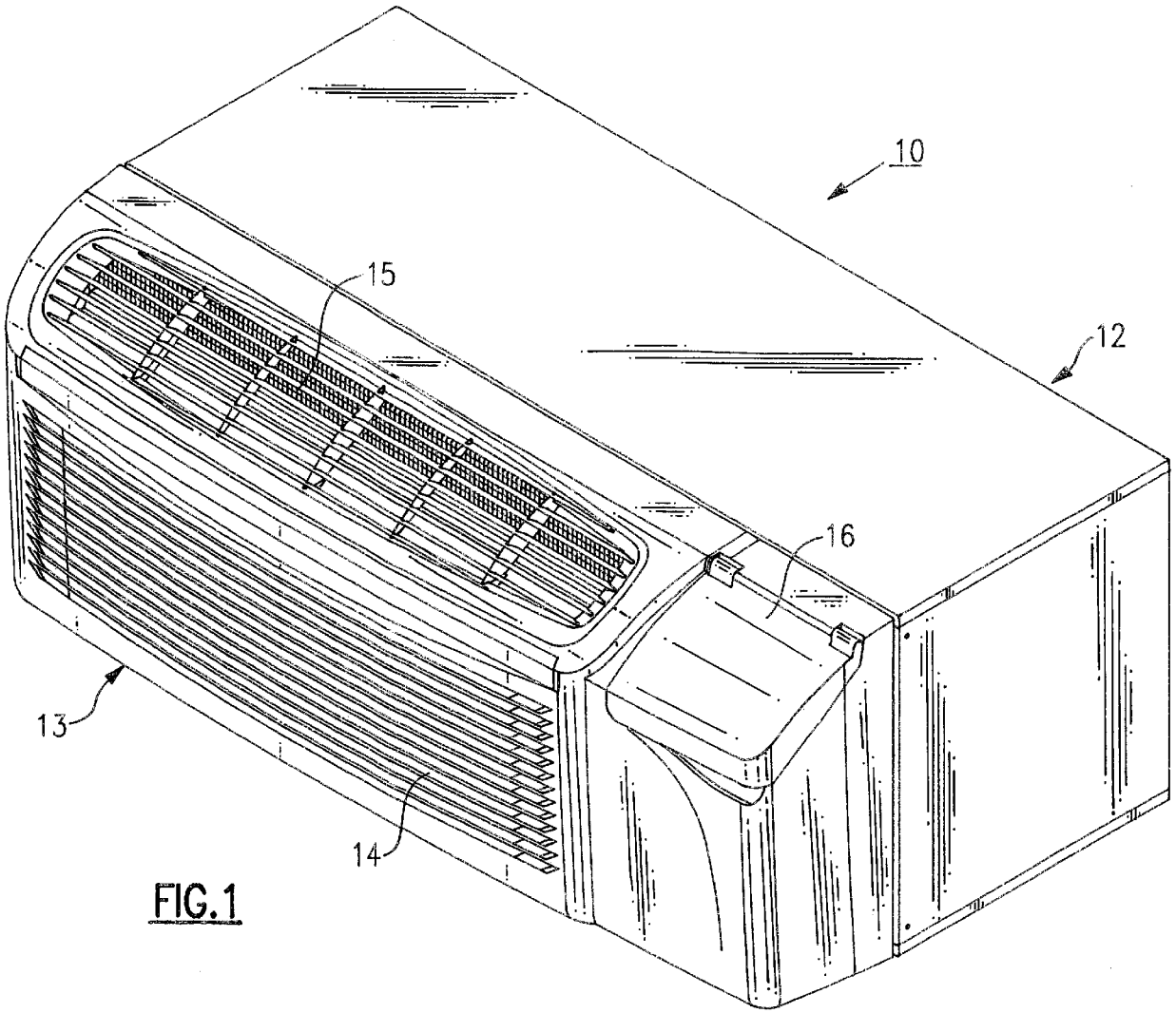
FIG. 1 is a front perspective view of an air conditioning unit that embodies the teachings of the present invention.

Turning initially to FIG. 1, there is illustrated a packaged terminal air conditioner, generally referenced 10, that embodies the teachings of the present invention. The unit is contained in a rectangular shaped sleeve 12 and includes a removable front cover 13 that closes against the sleeve. An air inlet opening 14 is provided in the front cover through which return air from the comfort region being serviced by the unit is drawn. An air outlet opening 15 is also provided in the top part of the front cover through which conditioned air is passed back into the comfort area. The controls for the unit are mounted in a well behind the front cover and access to the controls is had through a hinged access door 16 mounted upon the front cover.

Figure 2:
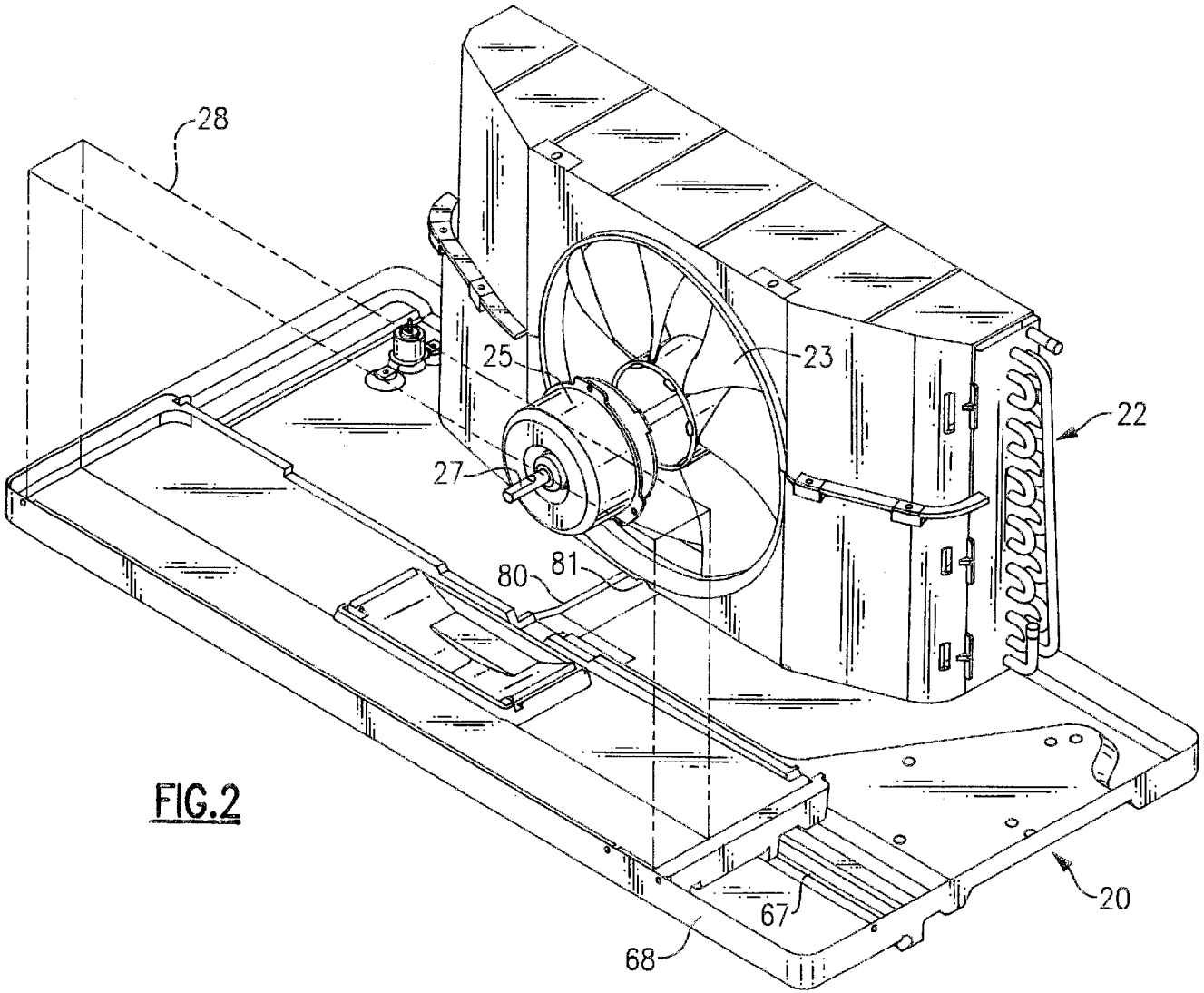
FIG. 2 is a front perspective view of the unit illustrated in FIG. 1 with portions broken away showing the base pan and the auxiliary pans employed in the practice of the present invention.

FIG. 2 illustrates the unit with the sleeve and front cover removed along with other components so that the base pan 20 of the unit can be more clearly viewed. The outdoor section 21 of the unit includes a housing 22 that contains the outdoor heat exchanger and a propeller type indoor fan 23 containing a slinger ring as described in greater detail in the above noted U.S. Pat. No. 6,085,539, the disclosure of which is herein incorporated by reference. As will be described below in greater detail, condensate produced by the indoor heat exchanger is conducted into the outdoor heat exchanger housing where the outdoor fan distributes the condensate over the outdoor heat exchanger surface to cool the surfaces and thus improve the efficiency of the unit.

Figure 5:
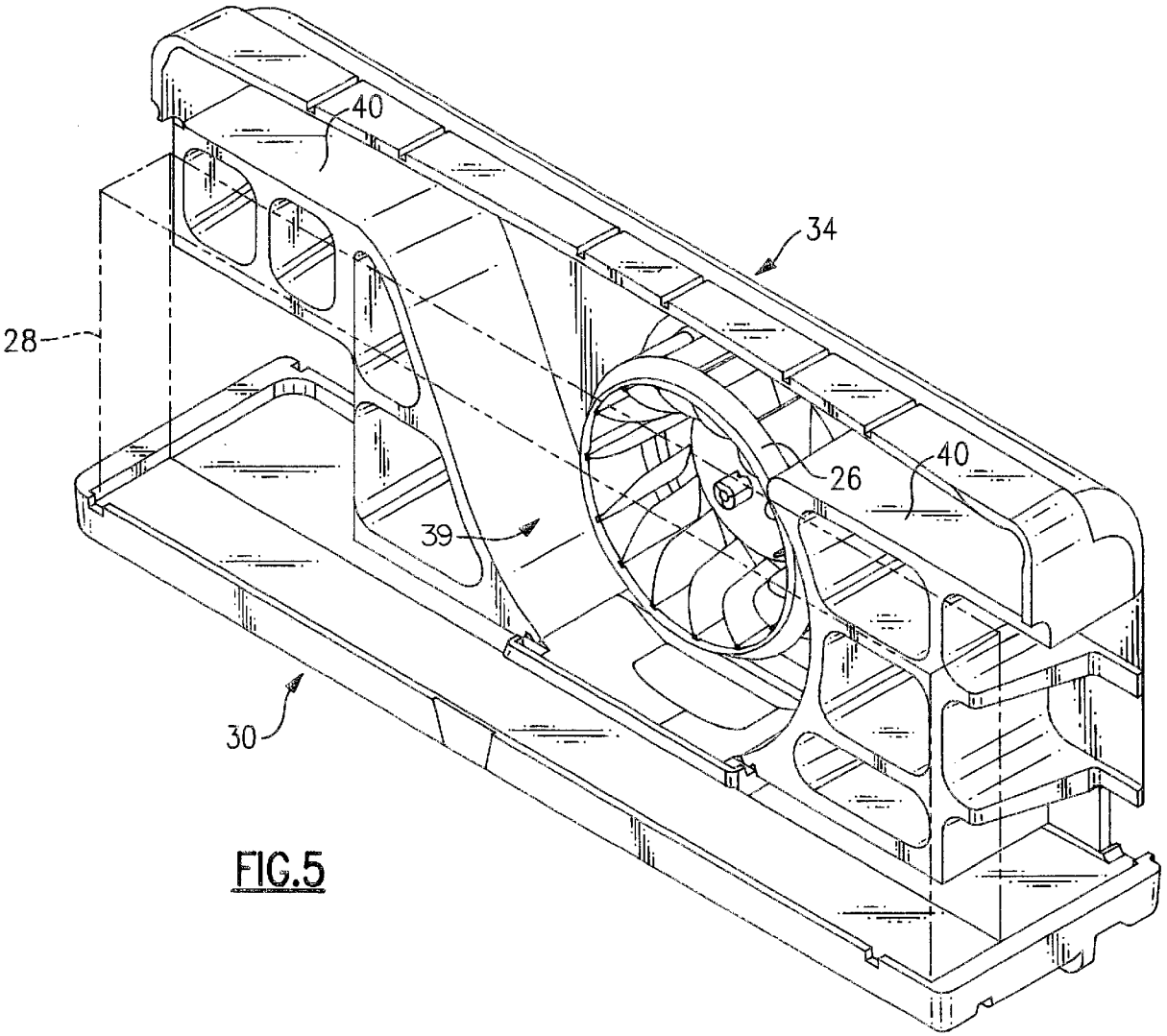
FIG. 5 is a further perspective view showing the indoor fan and the shroud surrounding the fan mounted upon the auxiliary pan.

A single fan motor 25 is employed in the present unit to drive both the indoor fan 26 (FIG. 5) and the outdoor fan of the unit. Although not shown, the indoor fan is mounted for rotation upon motor shaft 27 immediately behind the indoor heat exchange 28 which is shown in phantom outline in FIGS. 2 and 5. As illustrated in FIG. 5, the indoor heat exchanger 28 is seated upon an auxiliary pan 30 which, in turn, is mounted upon the floor 32 of the base pan 20. The indoor fan is contained within a shroud assembly 34 that extends across the width of the air outlet opening in the front cover of the unit. The shroud has an inside surface that forms a spiral shaped scroll 39 around the fan. The volute opens into a horizontal passage 40 that is positioned above the indoor heat exchanger and which extends along the length of the indoor heat exchanger. The shroud 39 and the passage 40 are designed to coact with the fan to distribute conditioned air uniformly across the air outlet opening in the front cover so that an even flow of conditioned air is discharged into the comfort area.

Figure 4:
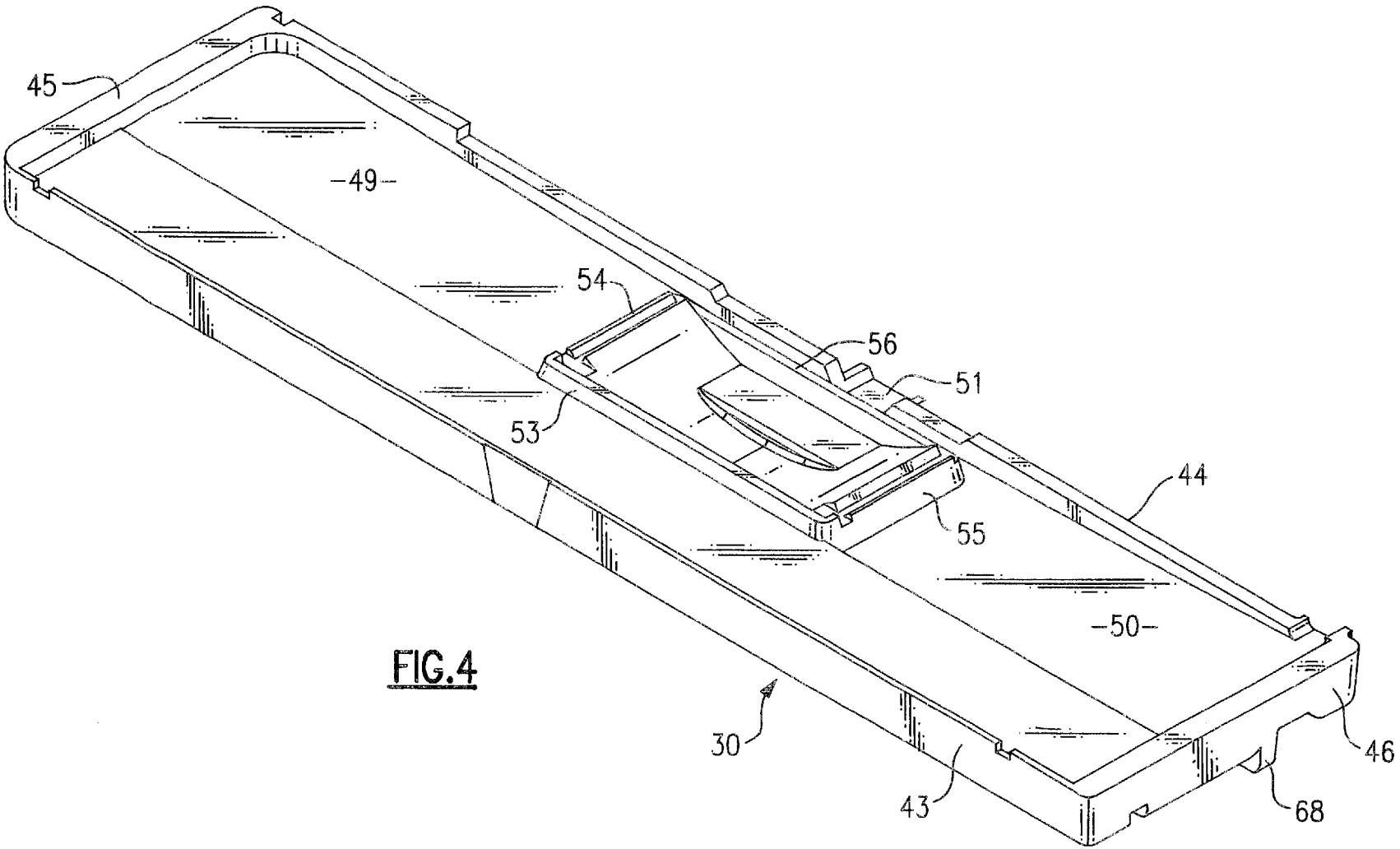
FIG. 4 is a perspective view of the auxiliary pan that is insertable within the base pan shown in FIG. 3.

It should be noted that because of the geometry of the scroll, a section of the scroll passes downwardly through the upper part of the auxiliary pan and is contained within a trough 42. As illustrated in FIG. 4, the auxiliary pan contains raised opposed side walls 43 and 44 and raised opposed end walls 45 and 46. A raised horizontally disposed platform 47 extends across the length of the auxiliary pan along side wall 43. The indoor heat exchanger 28 is seated upon the platform in assembly. The main floor of the auxiliary tray contains a first section 49 and a second section 50. Each section slopes downwardly from the opposed end walls of the pan toward a discharge spout 51 formed in the side wall 44. Condensate leaving the indoor heat exchanger is thus directed into the spout by the inclined floor sections.

Trough 42, which forms a section of the fan scroll 39 contains four raised walls 53–56 which prevent condensate flowing over the floor section from entering the scroll region. The condensate is thus directed around the trough directly into the spout 51.

Figure 3:
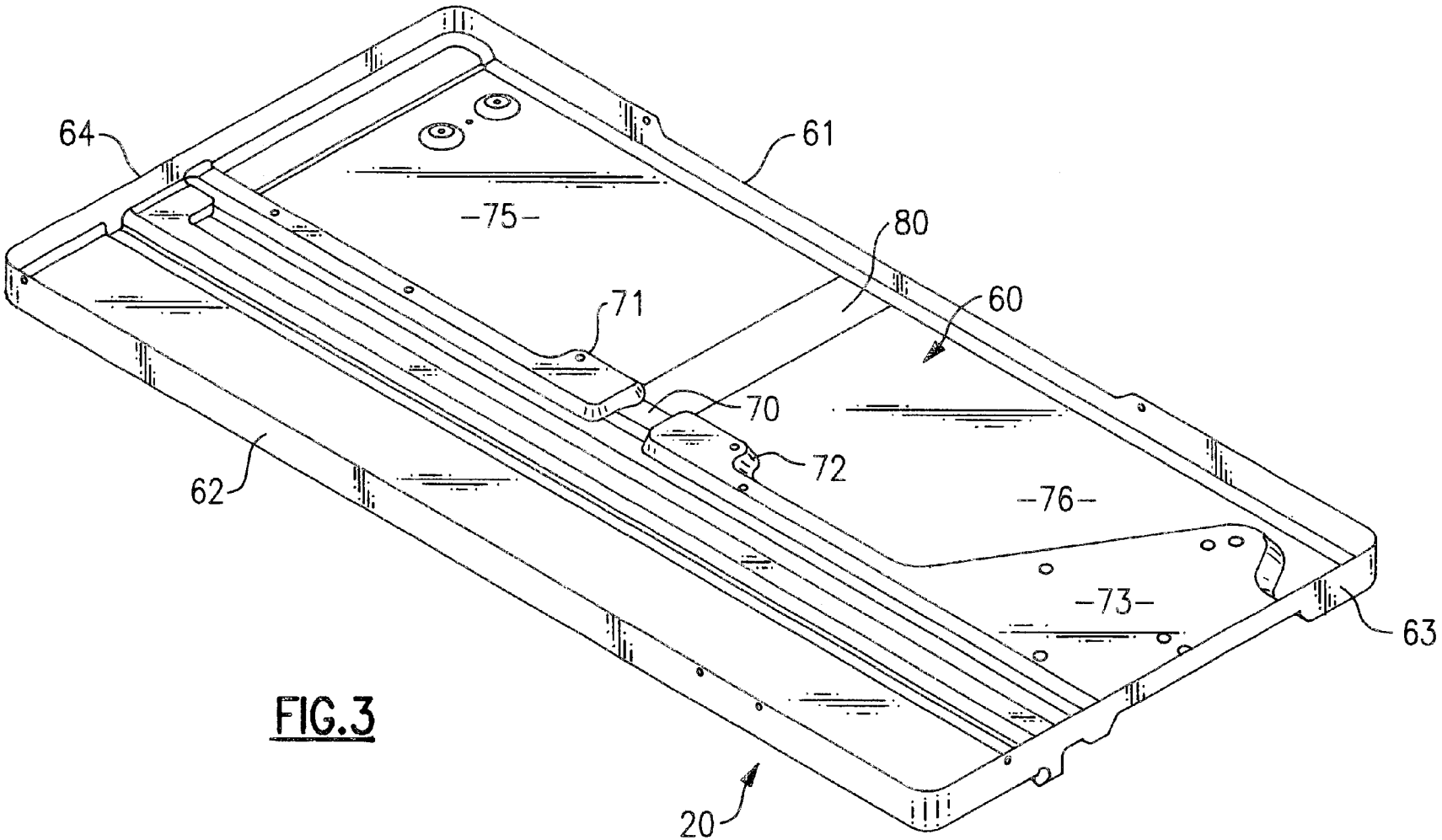
FIG. 3 is a perspective view illustrating the base pan employed in the practice of the present invention.

The base pan 20 is illustrated in FIG. 3 and, like the auxiliary pan, contains a floor generally designated 60 and four raised side walls 61–64. The floor contains a horizontally disposed flat section 65 that runs parallel to the side wall 62 along the length of the pan. A recessed groove 67 runs parallel to the flat section of the floor and is adapted to receive therein a rib 68 formed in the bottom of the auxiliary pan to align the auxiliary pan within the base pan. In assembly walls 43 and 45 of the auxiliary pan are registered against walls 62 and 64, respectively, of the base pan which brings the spout 51 of the auxiliary pan in vertical alignment with the axis of the fan shaft 27. With the auxiliary pan so registered, the spout 51 of the auxiliary pan is received within the opening 70 located between two raised embossments 71 and 72 on the floor of the base pan. A close sliding fit is provided between the spout and the opening to prevent the auxiliary from moving laterally within the base pan. Condensate moving through the of spout is thus delivered into the lower portion of the base pan.

The lower portion of the base pan contains a raised equipment platform 73 adjacent to side wall 63 upon which the unit compressor and other components are mounted. Here again, the lower portion of the pan includes two inclined sections 75 and 76 that slant downwardly toward a channel 80 located in the mid-section of the base pan. The channel is located beneath the central axis of the fan motor so that condensate delivered into the base pan is moved rapidly into an area beneath the outdoor fan. As illustrated in FIG. 2, the channel 80 is arranged to direct condensate that is gravity fed through the spout 51 from the high auxiliary pan into an orifice 81 formed in the lower part of the outdoor heat exchanger housing. The orifice is contoured so that the fan draws a negative pressure over the orifice so that condensate at the orifice entrance is drawn rapidly into the housing and is distributed over the heat exchanger surfaces.

The base pan of the present unit is formed from a single piece of metal The auxiliary pan, on the other hand, is cast of light-weight styrene as is the shroud assembly that surrounds the indoor fan and directs conditioned air into the comfort area. The casting of the auxiliary pan has many advantages over the prior art. Not only does it lighten the unit, but is also permits complex shapes such as the scroll section to be fabricated to very close tolerances on an economic basis. It should be further noted that the present two pan system provides the shortest path for condensate to reach the entrance to the orifice in the housing. As a result, the condensate becomes available for use in the cooling process almost immediately after the unit is put into operation.

While this invention has been explained with reference to the structure disclosed herein, it is not confined to the details set forth and this invention is intended to cover any modifications and changes as may come within the scope of the following claims.

What is claimed is:

1. Apparatus for supporting the components of an air conditioner unit having an indoor section and an outdoor section, each of which contain a heat exchanger and a fan for passing air over the associated heat exchanger, said apparatus includes:

a base pan having a floor and four raised sides for encircling said unit; and an auxiliary pan mounted inside the base pan beneath the indoor fan and an indoor heat exchanger, said auxiliary pan containing a trough located beneath the indoor fan having a contoured inside surface that forms a section of a shroud for distributing conditioned air within the unit.

2. The apparatus of claim 1 wherein said auxiliary pan has means for collecting condensate from said indoor heat exchanger and delivering said condensate into said base pan.

3. The apparatus of claim 2 wherein said trough contains a raised wall for preventing collected condensate from entering said trough.

4. The apparatus of claim 2 wherein the floor of the base pan slopes inwardly into a reservoir area whereby condensate delivered into the base pan flows into the reservoir.

5. The apparatus of claim 1 wherein said base pan contains spaced apart raised rails on the floor of said base pan and said auxiliary pan contains spaced apart rails on its bottom surface that mate with the rails on the floor of the base pan.

6. The apparatus of claim 4 wherein said channel is axially aligned with the central axis of said outdoor fan.

7. A base pan assembly for an air conditioner unit containing an indoor section and an outdoor section, each of which further includes a heat exchanger and a fan for moving air over the heat exchanger, a main base pain having a floor and four raised side walls that are integral with said floor, said floor having a laterally extended channel that is axially aligned with the axis of the indoor fan; and a shroud unit having a lower auxiliary pan section that is mounted inside the main base pan and an upper section mounted upon the auxiliary pan, said shroud having a spiral opening that encircles said indoor fan, said shroud passing through both the upper and lower sections of the unit.

8. The assembly of claim 7 wherein the upper and lower sections of the scroll assembly are both fabricated of styrene.

* * * * *